US009914516B1

(12) United States Patent
MacDonald et al.

(10) Patent No.: US 9,914,516 B1
(45) Date of Patent: Mar. 13, 2018

(54) HYDROFOIL SHIELD

(71) Applicant: Dale MacDonald, Miami, FL (US)

(72) Inventors: Dale MacDonald, Miami, FL (US); Christopher M. Carlson, Melbourne, FL (US); Richard T. Bailey, Palm Bay, FL (US)

(73) Assignee: Dale MacDonald, Miami, FL (US)

( * ) Notice: Subject to any disclaimer, the term of this patent is extended or adjusted under 35 U.S.C. 154(b) by 0 days.

(21) Appl. No.: 15/416,977

(22) Filed: Jan. 26, 2017

(51) Int. Cl.
*B63H 5/16* (2006.01)
*B63H 20/34* (2006.01)
*B63B 1/24* (2006.01)

(52) U.S. Cl.
CPC ..... *B63H 5/165* (2013.01); *B63B 1/246* (2013.01); *B63H 20/34* (2013.01)

(58) Field of Classification Search
CPC ..... B63H 20/34; B63H 5/165; B63B 1/246
USPC ..... D12/317
See application file for complete search history.

(56) References Cited

U.S. PATENT DOCUMENTS 3,099,240 A * 7/1963 Montague, Jr. ..... B63B 1/36 114/281
5,207,605 A 5/1993 Kroeber
6,168,483 B1 1/2001 McIntosh
7,270,584 B1 9/2007 Mitchell
8,302,549 B2 * 11/2012 Templeman ..... B63H 20/34 114/274

* cited by examiner

*Primary Examiner* — Ajay Vasudeva
(74) *Attorney, Agent, or Firm* — McCormick, Paulding & Huber LLP

(57) ABSTRACT

A hydrofoil shield for protecting a boat motor includes a shield body, two fins, a nose section, and a tail section, wherein the shield body has a central shield portion with fins extending therefrom and the nose section disposed forward of the body, wherein the shield body and fins are symmetrical about a longitudinal axis extending from the nose section to the tail section, and wherein the fins curve toward the central shield portion at a dihedral/sweep angle forming a U-like shape.

7 Claims, 7 Drawing Sheets

HYDROFOIL SHIELD

TECHNICAL FIELD

The present disclosure relates generally to powerboats and, more particularly, to an underwater accessory for powerboats.

BACKGROUND

A boat can encounter various underwater hazards such as rocks, oyster beds, tree stumps, moorings, coral and the like not visible from above the water surface while navigating a body of water. These hidden structures can damage the boat and propeller.

SUMMARY

The present disclosure provides an improved hydrofoil shield for protecting a boat motor while dramatically improving performance by reducing drag and increasing lift.

The hydrofoil shield includes a shield body, two fins, a nose section, and a tail section. The shield body has a central shield portion with the two fins extending therefrom and the nose section and tail section being disposed forward and aft of the shield body, respectively. The shield body and fins are symmetrical about a longitudinal axis extending from the nose section to the tail section, with the fins curving toward the central shield portion at a dihedral/sweep angle to form a U-like shape.

The hydrofoil shield may further include a snub-nose section with an angled forward end.

The hydrofoil shield further includes a recessed area disposed within the central shield portion and extending toward the nose section for attaching L-shaped mounting brackets to the hydrofoil shield and affixing the hydrofoil shield to a boat motor.

These and other objects, features and advantages of the present disclosure will become apparent in light of the following description of non-limiting embodiments, with reference to the accompanying drawings.

DETAILED DESCRIPTION

Figure 1:
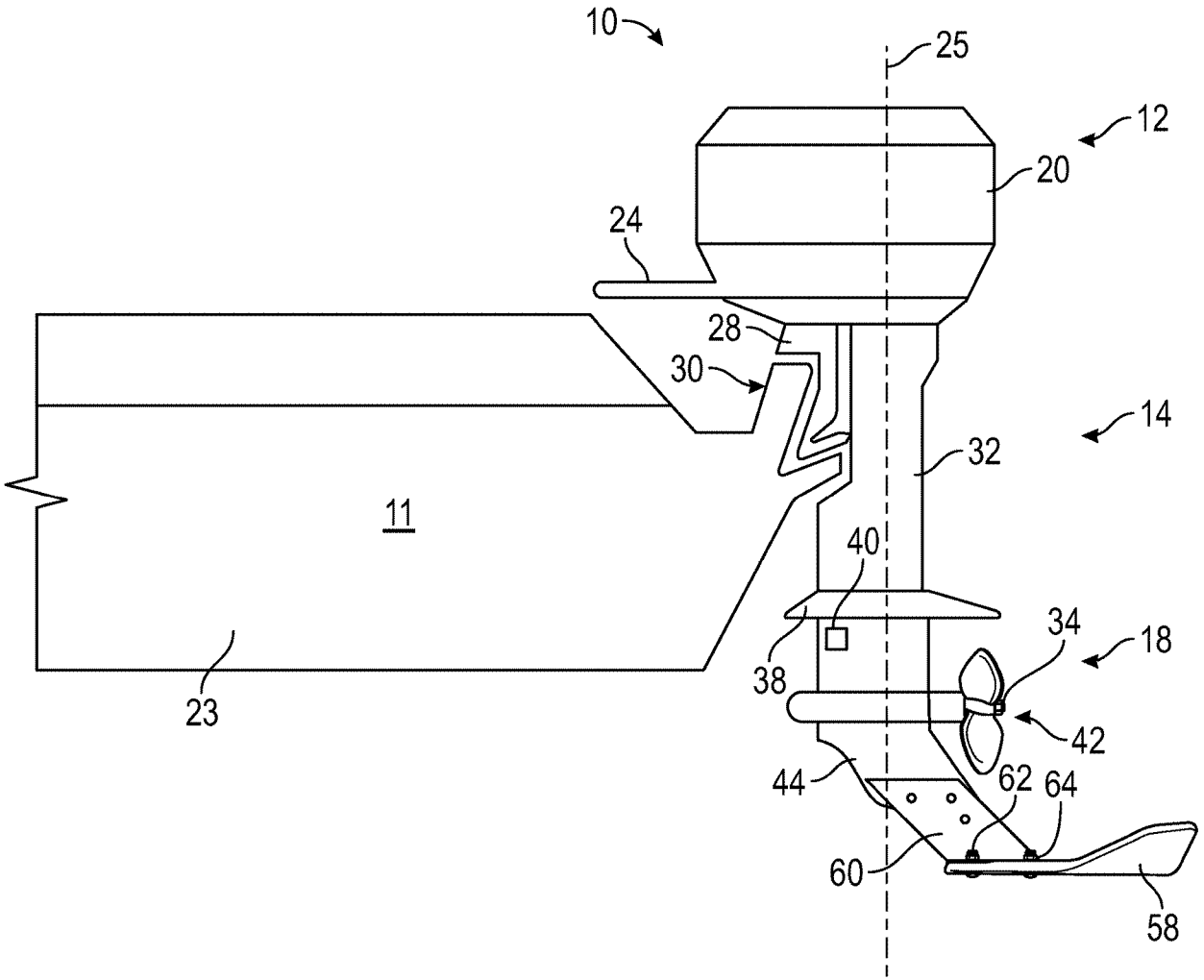
FIG. 1 is a side view of an outboard motor affixed to a boat with a hydrofoil shield.

Referring to FIG. 1, an outboard motor 10 for propelling a boat 11 typically includes a top power-head section 12 extending to a midsection 14 and a lower unit 18 further extending away from the top power-head section 12 and midsection 14. The top power-head section 12 includes an engine section 20 for powering the boat 11 and a steering system for steering the boat 11, such as a tiller 24 extending substantially perpendicular from a longitudinal direction 25 of the outboard motor 10.

The midsection 14 of the outboard motor 10 typically includes a motor bracket 28 for affixing the outboard motor 10 to a transom section 30 of the boat 11 and an exhaust housing 32. The exhaust housing 32 houses an exhaust pipe (not shown) extending to an exhaust outlet 34.

The lower unit 18 of the outboard motor 10 typically includes an anti-ventilation plate 38, a water inlet 40, a propeller unit 42 and a skeg 44. The anti-ventilation plate 38 is disposed between the exhaust housing 32 and the propeller unit 42, and projects away from the boat 11 over a portion of the propeller unit 42.

Figure 2:
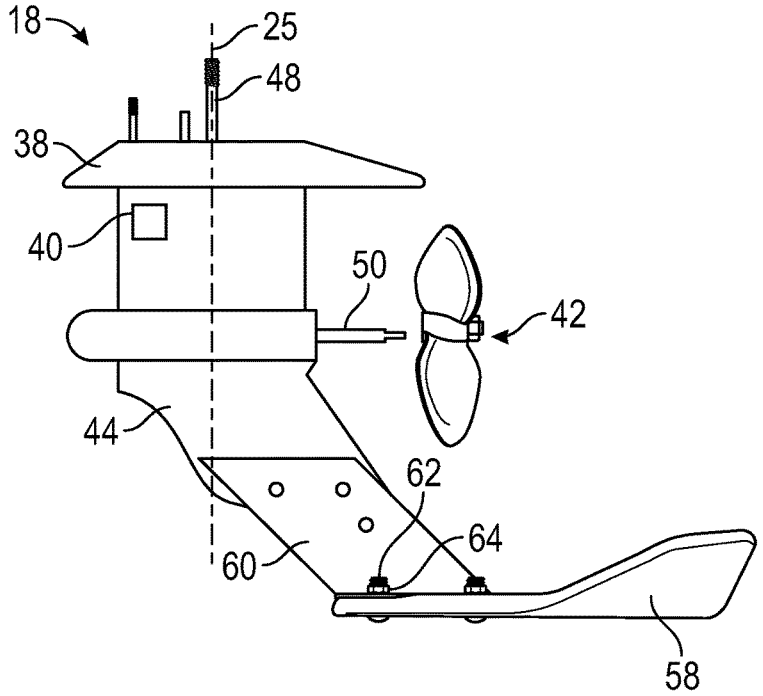
FIG. 2 is an enhanced, partially cut-away side view of a lower section of the outboard motor of FIG. 1 with the hydrofoil shield and a propeller unit detached.

Referring to FIG. 2, the propeller unit 42 is connected to, and driven by, a drive shaft 48 of an engine disposed in the engine section 20 (shown in FIG. 1) via a propeller shaft 50. The drive shaft 48 extends in the longitudinal direction 25 from the engine section 20 (shown in FIG. 1) and into the lower unit 18. The propeller shaft 50 is substantially perpendicular to the drive shaft 48 and engages the drive shaft 48 in the lower unit 18 through appropriate gearing or the like. The propeller shaft 50 extends outward from the lower unit 18 and has the propeller unit 42 affixed to its distal end.

Figure 3:
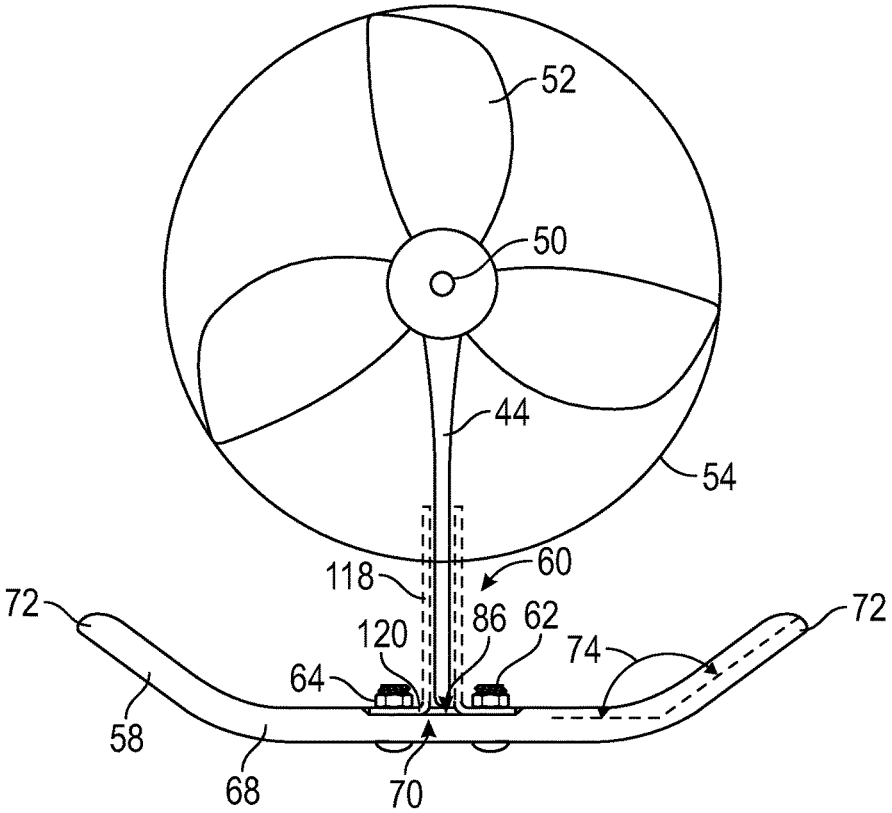
FIG. 3 is a front view of the hydrofoil shield and lower section of the outboard motor of FIG. 2 including the propeller.

As seen in FIG. 3, the propeller unit 42 includes a plurality of blades 52 that define a circular path 54 about the propeller shaft 50.

A hydrofoil shield 58 according to the present disclosure affixes to the skeg 44 of the outboard motor 10 below the circular path 54 via L-shaped mounting brackets 60 and is fastened by bolts 62 and nuts 64, or other similar attachment devices.

The hydrofoil shield 58 includes a body 68 having a central shield portion 70 with fins 72 extending therefrom. The fins 72 of the hydrofoil shield 58 curve at a dihedral/sweep angle 74, thereby providing the hydrofoil shield 58 with a U-like shape. The dihedral/sweep angle 74 is between 140 and 170 degrees, more preferably, between 160-165 degrees, 150-155 degrees or 140-145 degrees depending upon an overall size of the body 68.

Figure 4:
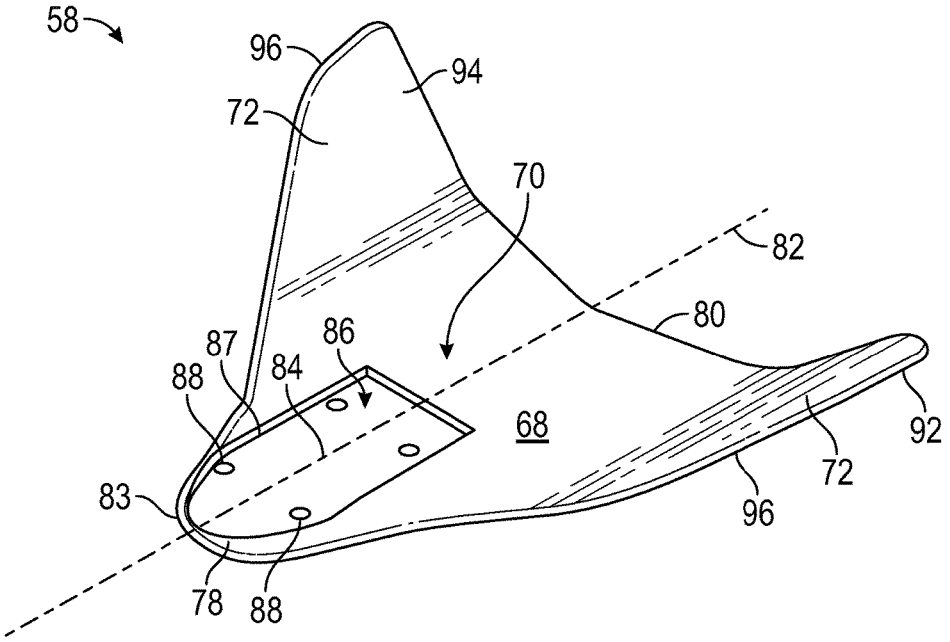
FIG. 4 is a perspective view of the hydrofoil shield of FIGS. 2-3.

Referring to FIG. 4, the hydrofoil shield 58 further includes a nose section 78 extending from a front tip of the hydrofoil shield 58 to the central shield portion 70 and a tail section 80 further extending away from the nose section 78 and central shield portion 70 to a rear of the hydrofoil shield 58. The hydrofoil shield 58 is substantially symmetrical about a longitudinal axis 82 extending from the nose section 78 to the tail section 80. The nose section 78 includes a snub-nose arc shape that tapers to the fins 72 from a central forward point 83. The arc shape of the nose section 78 is defined by a radius 84 extending from the central forward point 83 toward the tail section 80 along the longitudinal axis 82 to a distance in the range of 0.5 to 3 inches. Preferably the radius 84 is in the range of 1.1 to 1.2 inches and, even more preferably, is approximately 1.168 inches at the forward central point 83. In embodiments, the radius 84 may also vary within the ranges of 0.5 to 3 inches or 1.1 to 1.2 inches as the nose section 78 tapers from the central forward point 83 to the fins 72 depending upon an overall size of the body 68. The angle of attack at the forward point 83 is approximately zero degrees or flat.

Figure 6:
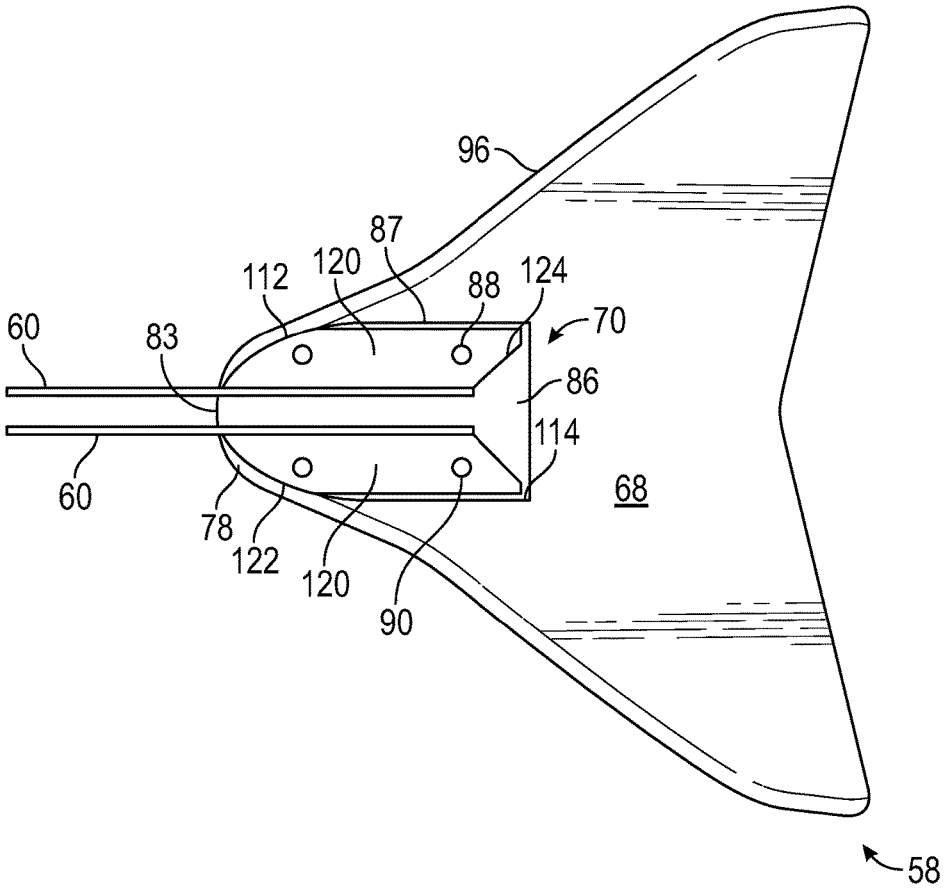
FIG. 6 is a top view of the hydrofoil shield of FIGS. 2-5.

The hydrofoil shield 58 includes a recessed area 86 at the central shield portion 70 and extending towards the nose section 78 for attaching the L-shaped mounting brackets 60 that affix the hydrofoil shield 58 to the skeg 44. A wall 87 of the recessed area 86 may have a reduced height near the nose section 78 as a thickness of the hydrofoil shield 58 may also be smaller at the nose section 78. Additionally, as seen in FIG. 6, the portion of the wall 87 with the reducing height may include a curved portion 112 as the wall extends to the nose section 78. A plurality of pre-drilled holes 88 extending through the shield 58 may be provided within the recessed area 86 to facilitate attachment of the mounting brackets 60 to the shield 58 and are positioned to align with holes 90 of brackets 60 (shown in FIGS. 6 and 7). The plurality of pre-drilled holes 88 can be arranged in a variety of configurations, such as a square configuration shown in FIG. 4, depending upon the configuration of the holes 90 of the mounting brackets 60 (shown in FIGS. 6 and 7). A lower side 92 and upper side 94 of the hydrofoil shield 58 are preferably both smooth and meet to define a periphery 96 of the hydrofoil shield 58.

Figure 5:
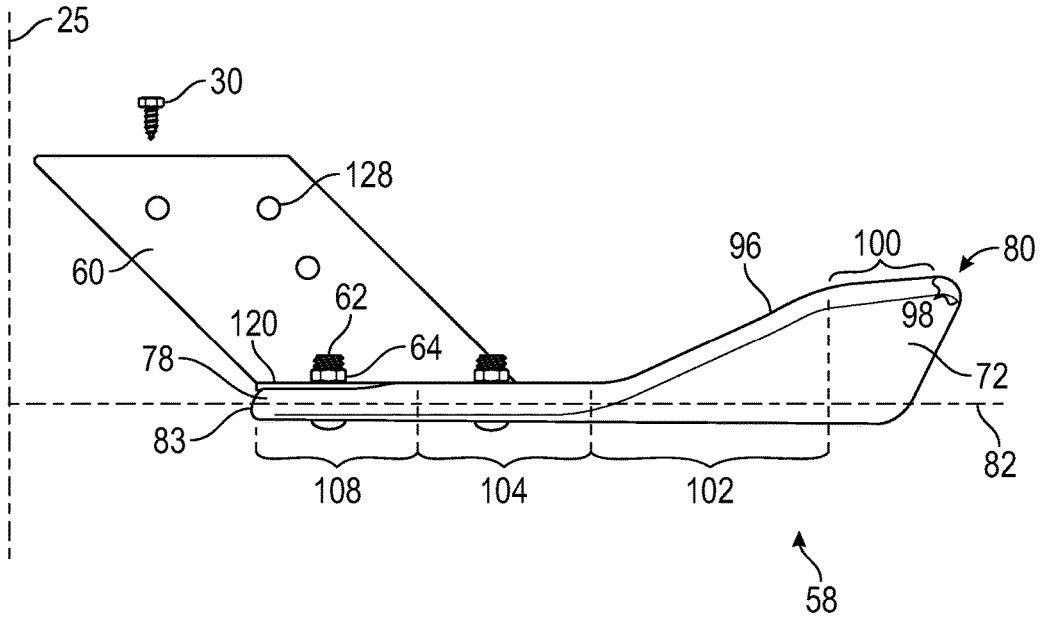
FIG. 5 is a side view of the hydrofoil shield of FIGS. 2-4.

Referring to FIG. 5, the fins 72 curve from the tail section 80 to the nose section 78 along periphery 96 at five curvature areas (98, 100, 102, 104, 108) having different slopes defined relative to the longitudinal axis 82 and the longitudinal direction 25 of the outboard motor 10 (shown in FIG. 1). For example, the five curvature areas sequentially transition into one another and include: a first area 98 curving away from the longitudinal axis 82 and toward the longitudinal direction 25; a second area 100 curving toward the longitudinal axis 82 and toward the longitudinal direction 25; a steeper third area 102 further curving toward the longitudinal axis 82 and toward the longitudinal direction 25; a generally flat fourth area 104 extending parallel to the longitudinal axis 82 and toward the longitudinal direction 25; and a fifth area 108 shallowly curving toward the longitudinal axis 82 and the longitudinal direction 25 toward the forward point 83 of the nose section 78.

Referring back to FIG. 3, each L-shaped mounting bracket 60 includes a side section 118 formed with a perpendicular lower section 120. The lower sections 120 fit within the recessed area 86 and are secured by the threadedly connected nuts 64 and bolts 62 or other similar fastening devices. Top surfaces of the lower sections 120 of the L-shaped mounting brackets 60 are preferably flush with the upper side 94 of the hydrofoil shield 58 but, depending upon size and strength requirements, the lower sections 120 of the L-shaped mounting brackets 60 may protrude slightly above the recessed area 86 or may be recessed slightly within the recess area 86. Recessing the mounting brackets 60 in the recessed area 86 reduces turbulent energy over the hydrofoil shield 58.

Referring back to FIG. 6, the mounting brackets' 60 lower sections 120 have a rounded front end 122 disposed towards the nose section 78 and an angled tail end 124 disposed back end of the recessed area 86 closer to the tail section 80. The rounded front end 122 transitions the lower sections 120 into the recessed area 86 along the portion of wall 87 with reduced height, while the angled tail end 124 is disposed substantially within the recessed area 86. The lower sections 120 include holes 90 that are positioned to align with the plurality of pre-drilled holes 88 extending through shield 58.

Referring back to FIG. 5, the mounting brackets 60 also include a plurality of mounting bracket holes 128 to allow screws 130 or other fasteners to secure the mounting brackets 60 to either side of the skeg 44, as shown in FIGS. 1-3.

Figure 7:
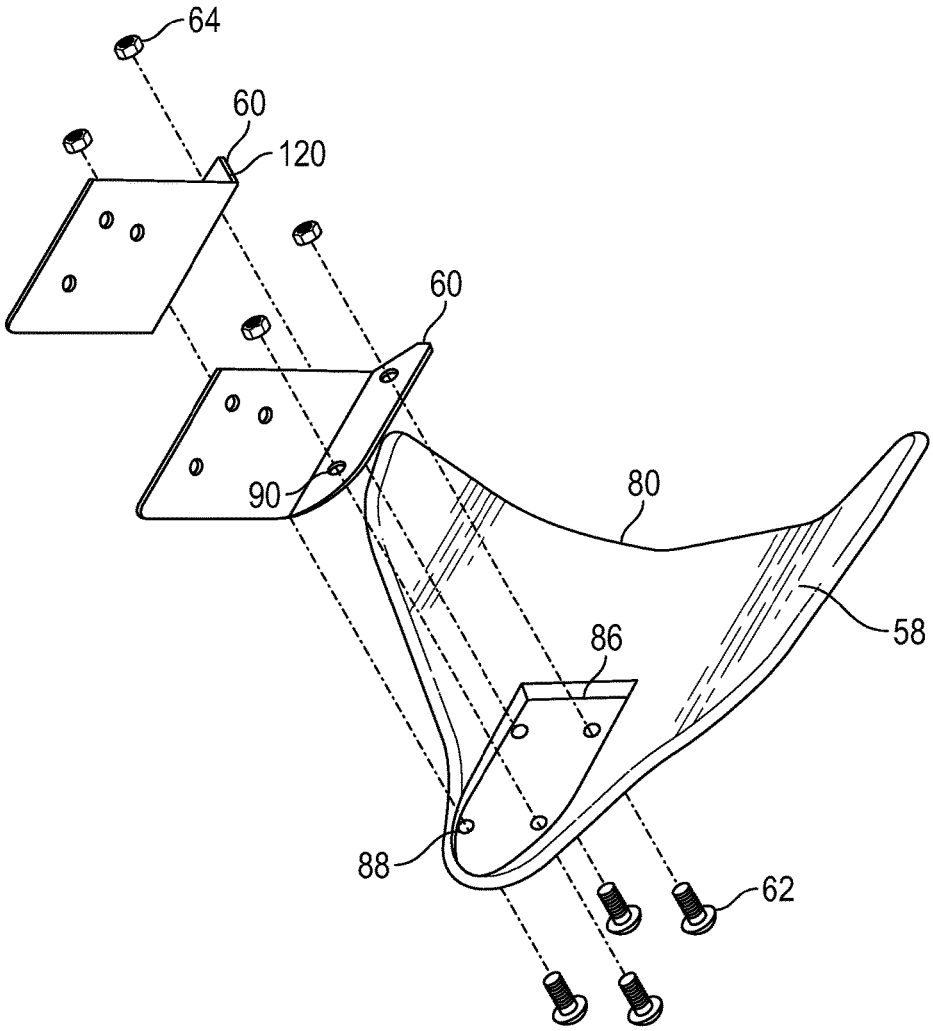
FIG. 7 is a perspective, exploded view of the hydrofoil shield of FIGS. 2-6, including mounting brackets, bolts and nuts.
Figure 8:
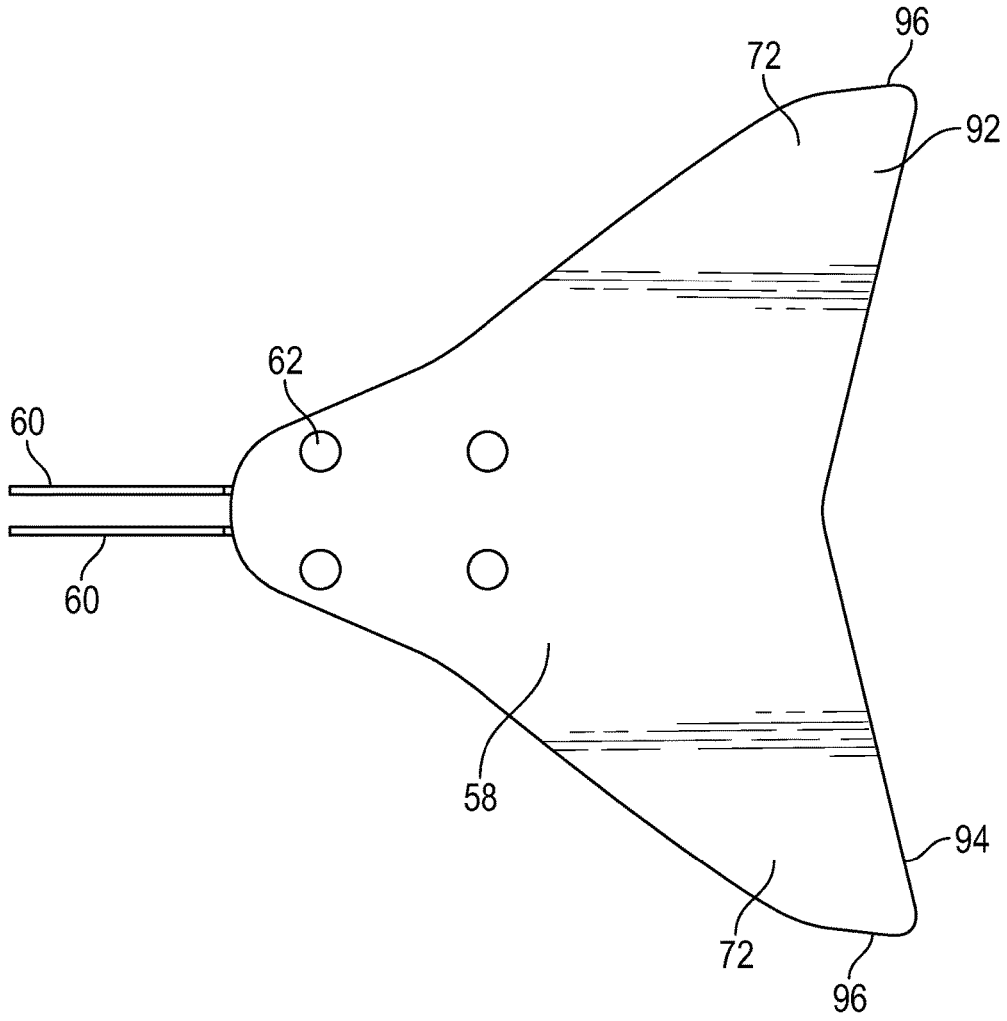
FIG. 8 is a bottom view of the hydrofoil shield of FIGS. 2-7.

Referring to FIGS. 7 and 8, the bolts 62 protrude through the plurality of pre-drilled holes 88 disposed within the hydrofoil 58 and the holes 90 disposed within the lower sections 120 of the L-shaped mounting brackets 60 and the nuts 64 attach to the bolts 62 to secure the mounting brackets 60 in the recessed area 86, so that, during operation of the boat 11 (shown in FIG. 1), turbulent energy from the propeller unit 42, skeg 44 and movement of the boat 11 (shown in FIG. 1), is evenly distributed.

Figure 9A:
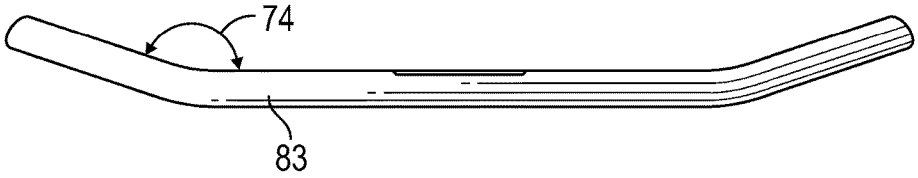
FIG. 9A is a front view of an optimized dihedral/sweep angle for a fin of the hydrofoil shield of FIGS. 2-8.
Figure 9B:
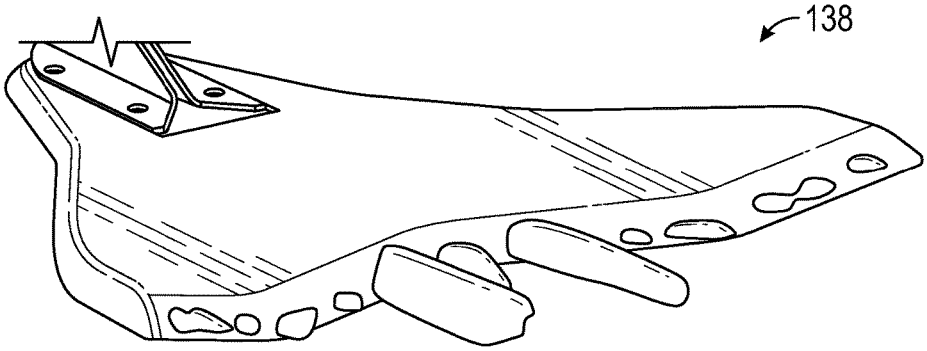
FIG. 9B is turbulent energy plot of the optimized dihedral/sweep angle for the hydrofoil shield of FIG. 9A.

Referring to FIGS. 9A and 9B, an exemplary hydrofoil shield 58 according to the present disclosure, having a zero degree angle of attack at the leading edge and a dihedral/sweep angle 74 of approximately 161.63 degrees, 153.4 degrees, or 143.5 degrees, produces significantly less turbulent energy than conventional hydrofoils of similar overall size without such a dihedral/sweep angle, as illustrated by turbulent energy plot 138.

Referring back to FIGS. 1-3, in operation, the boat 11 is initially floating due to its buoyancy and the shape of boat hull 23. The outboard motor 10 of boat 11 is positioned so that the lower unit 18 is beneath the surface of the water and the propeller unit 42 spins blades 52 to generate thrust propelling the boat 11 forward. As the speed of the boat 11 increases, hydrodynamic lift increases until the boat is considered "planning" or "at plane," at which point the hydrodynamic lift is the predominate upward force on the boat 11 rather than the buoyant force. The hydrofoil shield 58 of the present disclosure advantageously generates hydrodynamic lift as it travels under the water, allowing the boat 11 to reach plane or be "at plane" more quickly and with less required thrust from the propeller unit 42 than a boat without a hydrofoil or a boat with a conventional hydrofoil.

The hydrofoil shield 58 of the present disclosure generates increased lift while also having dramatically reduced drag when compared to other commercially available underwater accessories and/or hydrofoils. Thus, the efficiency boat 11 is increased.

For example, an approximate dihedral/sweep angle 74 of 161.63 degree, 153.4 degrees, or 143.5 degrees for the fins 72 allows for reduction in height of the hydrofoil shield 58, thereby reducing drag in addition to increasing lift. Additionally, providing the dihedral/sweep angle 74 at approximately 161.63 degrees, 153.4 degrees, or 143.5 degrees, reduces side slip of the boat 11, even as compared to boats having similar sized conventional hydrofoils without such a dihedral/sweep angle. This optimized dihedral/sweep angle 74 advantageously reduces turbulent energy (as shown comparing turbulent energy plot 138) as compared to other hydrofoils by 67% and drag by approximately 3.5 lbf at 21 mph of thrust. Additionally, the dihedral/sweep angle 74 at approximately 161.63 degrees shows a lift increase of 58 lbf at approximately 21 mph of thrust through experimental data as compared to similar sized conventional hydrofoils. Similarly, the dihedral/sweep angles 74 at approximately 153.4 degrees or 143.5 degrees also show similar lift increases at approximately 21 mph of thrust through experimental data as compared to similar sized conventional hydrofoils without such a dihedral/sweep angle.

Accordingly, an outboard motor 10 equipped with the hydrofoil shield 58 of the present disclosure provides better performance in lifting the boat 11 so that, when "at plane," a user experiences a more stable ride.

The hydrofoil shield 58 may advantageously be formed of a thermoplastic material adapted to flex on impact and to absorb contact with other objects such as oyster beds, moorings, tree stumps, coral, rocks and the like so as to protect the motor 10 and also not become damaged itself. The mounting brackets 60 may also be formed of a thermoplastic material or fabricated from metal to provide greater rigidity and stability to the hydrofoil shield 58.

Accordingly, when operating in shallow water, the hydrofoil shield of the present disclosure advantageously protects the propeller unit 42 and/or blades 52 from underwater obstructions and the costly consequences of damage to the outboard motor 10, engine and/or the environment.

The hydrofoil shield of the present disclosure also advantageously deflects some of the force and/or objects located on either side of the skeg 44 that might otherwise reach the propeller unit 42 unimpeded, especially when turning.

The hydrofoil shield 58 also advantageously protects animals, such as dolphins, manatees and turtles from the propeller unit 42 and blades 52.

The hydrofoil shield 58 of the present disclosure also advantageously evenly distributes turbulent energy across its body 68 and fins 72 during operation of the boat 11.

As will be recognized by those of ordinary skill in the pertinent art, numerous modifications and substitutions can be made to the above-described embodiments of the present disclosure without departing from the scope of the disclosures. For example, while the nuts 64, bolts 62, mounting brackets 60, plurality of pre-drilled holes 88, holes 90 on lower sections 120, and plurality of mounting bracket holes 128 have been described as arranged in particular configurations, it should be understood that the nuts 64, bolts 62, brackets 60 and holes 88, 90, 120 may be arranged in any suitable configuration in accordance with the principles of the present disclosure. Additionally although the hydrofoil shield 58 is described primarily in connection with an outboard motor 10, for simplicity, the hydrofoil shield 58 may be equally applicable to an inboard motor, an inboard/outboard motor, the outdrive of an inboard/outboard motor, or even a boat with no motor that has a skeg 44 or rudder that projects below a boat.

What is claimed is:

1. A hydrofoil shield for protecting a boat motor comprising:

a central shield portion;

two fins, each fin extending laterally from either side of the central shield portion;

a nose section disposed forward of the central shield portion;

a tail section disposed aft of the central shield portion; and a recessed area formed in an upper surface of the central shield portion for accommodating L-shaped mounting brackets that affix the hydrofoil shield to the boat motor, the recessed area including a wall that reduces in height as it nears the nose section;

wherein the central shield portion and fins are symmetrical about a longitudinal axis extending from the nose section to the tail section;

wherein the fins curve toward the central shield portion at a dihedral/sweep angle forming a U-shape.

2. The hydrofoil shield of claim 1, wherein the recessed area includes the wall of the recessed area curves as the height reduces near the nose section.

3. The hydrofoil shield of claim 1, wherein the dihedral/sweep angle between the fins and the central shield portion is between 140 and 170 degrees.

4. The hydrofoil shield of claim 1, wherein the dihedral/sweep angle between the fins and the central shield portion is between 160 and 165 degrees.

5. The hydrofoil shield of claim 1, wherein the dihedral/sweep angle between the fins and the central shield portion is between 140 and 145 degrees.

6. The hydrofoil shield of claim 1, wherein each fin has a lower side and an upper side that meet at a periphery of the hydrofoil shield, the periphery having a plurality of curve areas along each fin from the nose section to the tail section.

7. The hydrofoil shield of claim 6, wherein the periphery has at least five curve areas along each fin from the nose section to the tail section.

* * * * *